United States Patent [19]

Hillock

[11] Patent Number: 4,542,373

[45] Date of Patent: Sep. 17, 1985

[54] SMALL CRAFT PLUG DETECTOR

[76] Inventor: Edward E. Hillock, 6221 Lansbrook Ct., Oklahoma City, Okla. 73132

[21] Appl. No.: 531,090

[22] Filed: Sep. 12, 1983

[51] Int. Cl.[4] ..... G08B 21/00

[52] U.S. Cl. ..... 340/568; 114/197; 340/540; 340/687; 340/686

[58] Field of Search ..... 340/568, 540, 657, 686; 114/197, 270; 116/26, 1, 4, DIG. 1

[56] References Cited

U.S. PATENT DOCUMENTS

| | | | |
|---|---|---|---|
| 2,909,144 | 10/1959 | Baldwin | 114/197 |
| 3,018,751 | 1/1962 | Spurlock | 114/197 |
| 3,036,541 | 5/1962 | Musick et al. | 114/197 |

*Primary Examiner*—Glen R. Swann, III

*Attorney, Agent, or Firm*—Laney, Dougherty, Hessin, Claro & Beavers; Laney, Dougherty, Hessin, Claro & Beavers

[57] ABSTRACT

A small craft plug detector indicates whether a drain plug of a small boat or craft is installed. In a first embodiment a hollow cylindrical housing has upper and lower ends with central openings therethrough. An indicating plunger disposed within the housing has a rod which extends upwardly through the hole in the upper end of the housing and a lower end which extends downwardly through the opening in the lower end of the housing. A spring biases the plunger in an upward direction. Electrical contacts are provided so that an electrical connection may be made to activate a lamp, alarm, or the like when the plunger is moved downwardly. A second embodiment utilizes the electrical contacts of the first embodiment, but has no central opening in the upper end of the housing, and the plunger has no rod portion extending therethrough. A third embodiment of the invention is similar to the first embodiment, but does not include the electrical contacts.

16 Claims, 4 Drawing Figures

SMALL CRAFT PLUG DETECTOR

BACKGROUND OF THE INVENTION

1. Field of the Invention

This invention relates to detectors for indicating the position of a drain plug in a small boat or craft, and more particularly, to a detector having either a mechanically indicating plunger, an electrical switch to activate a lamp, alarm or the like, or a combination of such mechanically indicating plunger and electrical switch.

2. Brief Description of the Prior Art

The prior art relating to boat drain plugs is directed primarily at methods of opening and closing such a plug when the plug is located beneath a deck or behind a bulkhead. Such devices typically include a stem from the drain plug which extends through the deck or bulkhead so that the plug can be removed and reinstalled by turning a handle or pushing or pulling on a lever. U.S. Pat. Nos. 2,730,062 to Mitchell and 2,997,975 to Moeller also spring load the plug on such a stem to keep the plug in contact with the hole. The present invention uses a springloaded indicator, but the spring does not act against the plug itself. In fact, the plug detector of the present invention makes no changes in the design of the plug and is adaptable to any of the typical plugs used in small boats.

BRIEF DESCRIPTION OF THE PRESENT INVENTION

The small craft plug detector of the present invention is designed to indicate whether a drain plug of a small boat or craft is properly installed.

In a first embodiment of the apparatus, a housing forming a substantially hollow cylinder has an upper end with a central opening therethrough and a lower end with a central opening therethrough. An indicating plunger is disposed inside the housing. The plunger is formed by a rod portion having an upper end and an opposite lower end with a radially extending flange between said upper and lower ends. The upper end of the rod extends upwardly through the hole in the upper end of the housing, and the lower end of the rod extends downwardly through the central opening in the lower end of the housing. A gasket seals between the upper end of the rod and the hole through which it extends. A helical coil spring bears against the lower surface of the flange and a lower inside surface of the housing to bias the plunger in an upward direction. A pair of electrically conductive contacts extend through the upper end of the housing and are insulated from one another. An electrically conductive plate is attached to an upper surface of the flange on the plunger. A chain connects the lower end of the rod to the drain plug.

A second embodiment of the invention utilizes electrical contacts similar to the first embodiment, but has no central opening in the upper end of the housing. A plunger having a rod portion with a flange attached to the upper end thereof is disposed in the housing. A spring upwardly biases the plunger similarly to that of the first embodiment.

A third embodiment of the invention utilizes a housing and plunger essentially identical to the first embodiment, but has no electrical contacts therein. Thus, the third embodiment is a purely mechanical device.

An important object of the present invention is to provide a mechanical indication to the operator of a small boat or craft that the drain plug is not installed.

Another object of the invention is to provide an electrical switch to activate a lamp, alarm or the like to further alert the operator of the boat that the drain plug is not installed.

Additional objects and advantages of the invention will become apparent as the following detailed description of the preferred embodiments is read in conjunction with the accompanying drawings which illustrate such preferred embodiments.

DETAILED DESCRIPTION OF THE PREFERRED EMBODIMENT

Figure 1:
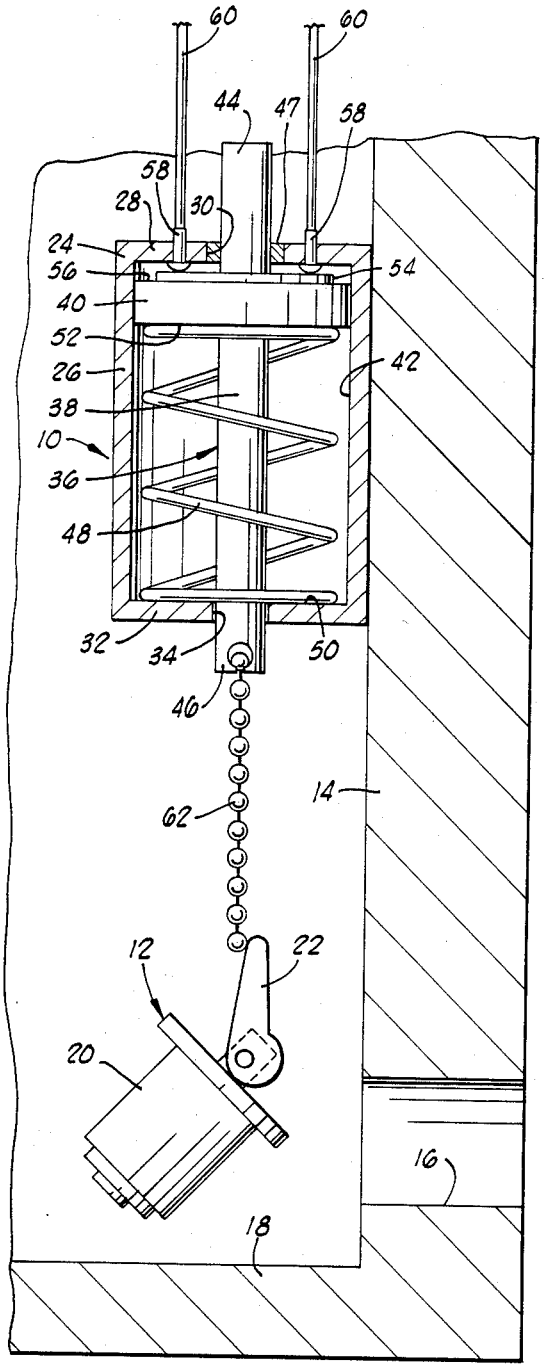
FIG. 1 shows the apparatus with a mechanical indicating plunger and electrical switch in the position when the boat plug is not installed.

Referring now to the drawings, the small craft plug detector of the present invention is designated generally by the numeral 10. The detector is designed to indicate whether a drain plug 12 of a small boat or craft is properly installed. Typically, such a boat has a transom 14 with a drain hole 16 therethrough adjacent a floorboard 18 at the stern. Plug 12 is comprised of a substantially cylindrical body portion 20 and a lever 22. When properly installed, body portion 20 fits in hole 16, and lever 22 is moved to a position which locks the plug in place.

Figure 2:
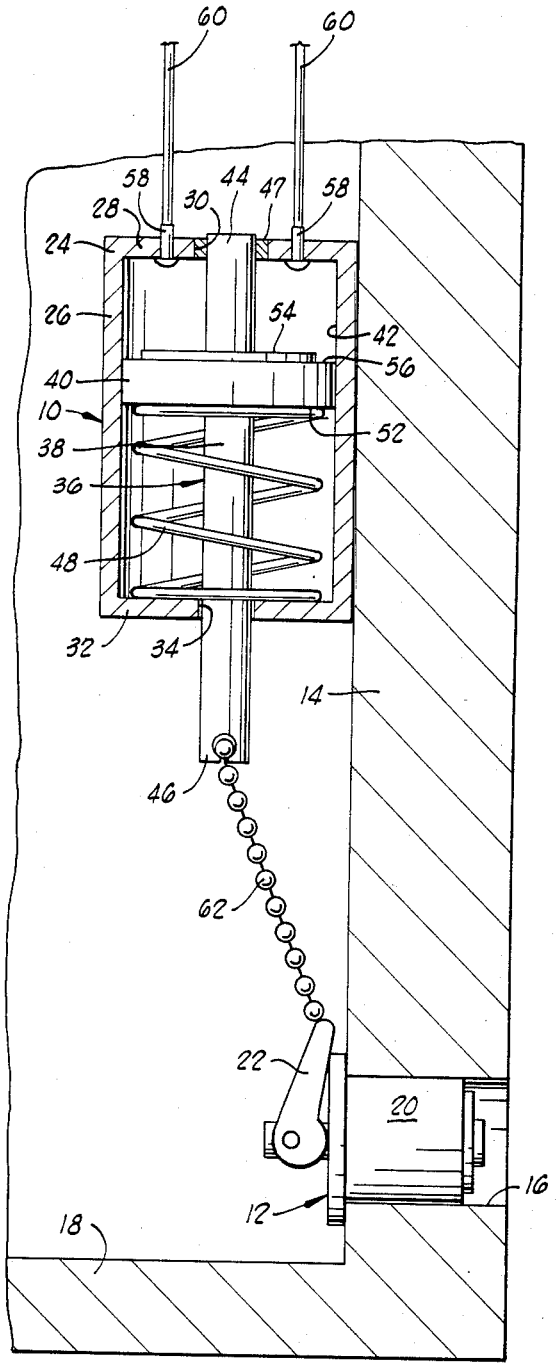
FIG. 2 shows the same apparatus as FIG. 1 when the plug is properly installed in the boat.

Referring now to FIGS. 1 and 2, a first embodiment of the apparatus is shown. A housing 24 has a substantially cylindrical portion 26 with a flat upper end plate 28 having a central opening 30 therethrough and a flat lower end plate 32 also having a central opening 34 therethrough. Thus, housing 24 forms a substantially hollow cylinder with an opening or hole in each end.

An indicating plunger 36 is formed by a rod portion 38 with a radially extending flange 40, as disposed in housing 24 for vertical reciprocation therein. The outside diameter of flange 40 is dimensioned such that it guides on an inside cylindrical surface 42 of housing 24. Flange 40 divides rod 38 into an upper end 44 extending upwardly through hole 30 and a lower end 46 extending downwardly through hole 34. Packing 47 seals between upper end 44 of rod 38 and hole 30 in upper end plate 28 of housing 24 to prevent foreign matter from entering the housing. A chain 62 connects a lower end 46 of rod 38 to lever 22 of drain plug 12.

A helical coil spring 48 bears against a lower inside surface 50 of housing 24 and a bottom surface 52 of flange 40 to bias plunger 36 in an upward direction. An electrically conductive plate 54 is attached to an upper surface 56 of flange 40. A pair of electrically conductive spaced contacts 58 extend through upper end plate 28 of housing 24 such that contacts 58 are insulated from one another. Wires 60 extend from contacts 58 leading to a lamp, alarm, or the like.

Figure 3:
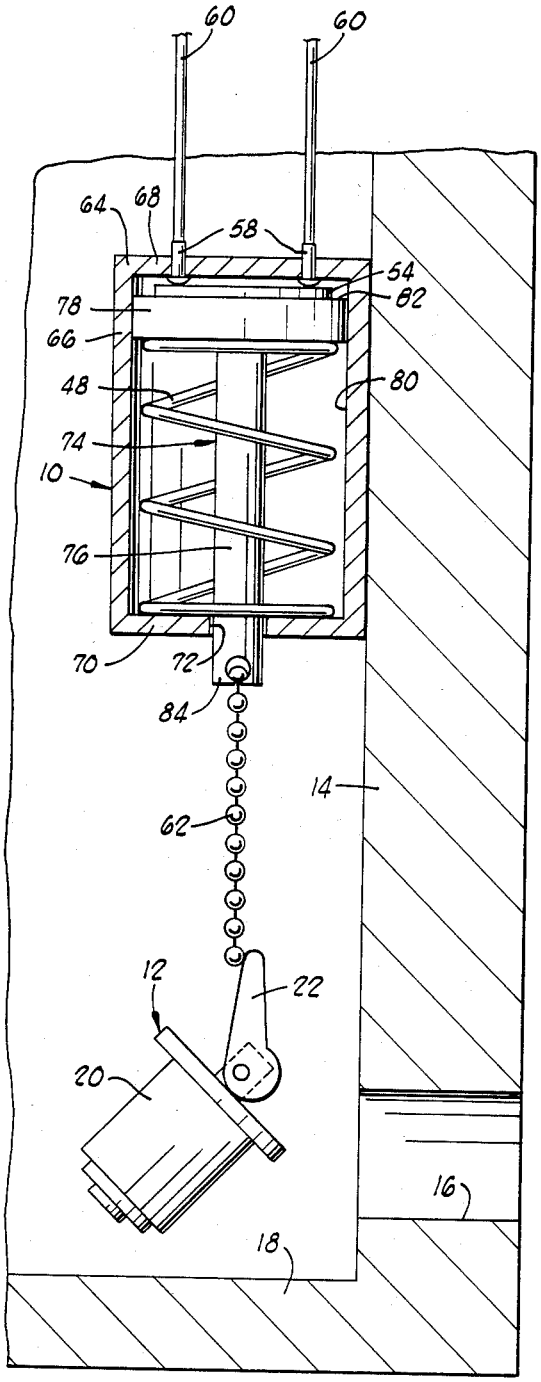
FIG. 3 indicates an alternative embodiment of the invention, having only an electrical switch, when the plug is not installed.
Figure 4:
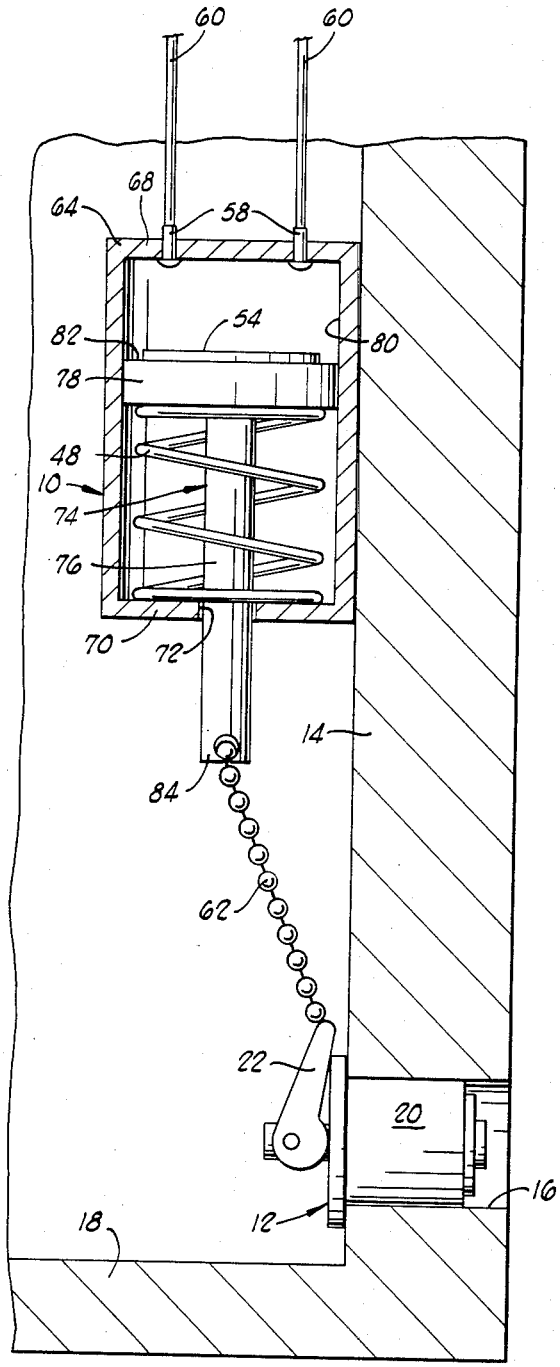
FIG. 4 shows the same apparatus as FIG.3 when the drain plug is properly installed in the boat.

In a second embodiment of the invention, as shown in FIGS. 3 and 4, a housing 64 has a substantially cylindrical portion 66 with a solid upper end plate 68 and a lower end plate 70 having a central opening 72 therethrough. A plunger 74 is vertically disposed in housing 64 and is formed by a rod portion 76 having a radially extending flange 78 at the upper end of rod 76. The outside diameter of flange 78 is dimensioned to guide on the inside cylindrical surface 80 of housing 64 such that plunger 74 vertically reciprocates in housing 64.

Plunger 74 is upwardly biased by spring 48 as hereinbefore described in the first embodiment. Other features which are essentially identical to the first embodiment are an electrical conducting strip 54 attached to an upper surface 82 of flange 78 and electrical contacts 58 extending through upper end plate 68 of housing 64. A chain 62 connects lower end 84 of rod 76 to lever 22 to drain plug 12.

A third embodiment, not specifically shown, uses the indicating plunger of the first embodiment, but omits the electrical components.

OPERATION OF THE INVENTION

Referring to the first embodiment, FIG. 1 illustrates the apparatus when drain plug 12 is not installed in hole 16. In this position, spring 48 is free to force plunger 36 to an uppermost position in which flange 40 is adjacent upper end plate 28 of housing 24. Upper end 44 of rod 38 protrudes extends through hole 30 as an indication that drain plug 12 is not installed. Also in this position, plate 54 places contacts 58 in electrical communication with one another, acting as a closed switch to complete an electrical circuit to activate a lamp, alarm or the like to further alert an operator of the boat that the drain plug is not installed.

Referring now to FIG. 2, the first embodiment is shown when drain plug 12 is installed in drain hole 16 of the boat. Chain 62 is of a predetermined length such that upper end 44 of rod 38 is in a position essentially flush with the outside of upper end plate 28 of housing 24 as an indication that the plug is installed. Also in this configuration, plate 54 is spaced away from electrical contacts 58, opening the switch so that there is no electrical communication between contacts 58, thus deactivating the lamp, alarm or the like.

The second embodiment, shown in FIGS. 3 and 4, operates in a similar fashion, except that there is no portion of the plunger extending through upper end plate 68 of housing 64, and therefore, there is no mechanical indicator. Electrical conducting plate 54 on flange 78 operates as a switch to place contacts 58 in electrical communication with one another when drain plug 12 is not installed, in a manner idential to that described for the first embodiment.

The plunger of the third embodiment operates identically to that in the first embodiment, but without the electical switch components.

Thus, in the first embodiment of the invention, a mechanical indicating plunger and an electrical switch alert the operator of a boat that the drain plug is not properly installed. In the second embodiment, only the electrical switch indicator is present, and in the third embodiment, only the mechanical indicating plunger is utilized. It can be seen, therefore, that the small craft plug detector of the present invention is well adapted to carry out the objects and attain the ends and advantages mentioned, as well as those inherent therein. While three presently preferred embodiments to the invention have been described for the purpose of this disclosure, numerous changes in the construction and arrangement of parts can be made by those skilled in the art. All such changes are encompassed within the scope and spirit of this invention as defined by the appended claims.

What is claimed is:

1. A plug detection apparatus to indicate position of a drain plug in a small boat or craft, said detection apparatus comprising:

an indicator housing;

an indicator plunger in said housing having a first end and a second end opposite said first end, said plunger having a first position in which said first end of the plunger is substantially flush with an outer surface of said housing and a second position in which said first end extends outwardly away from said housing outer surface;

spring means to bias said plunger from said first position to said second position; and connecting means of predetermined length connecting said second end of said plunger to said drain plug, whereby, when said plug is installed in said boat, said plunger is in said first position, and when said plug is not installed, said spring means moves said plunger to said second position.

2. Apparatus of claim 1 wherein:

said housing is characterized as a substantially hollow cylinder defining a cavity therein, and having an upper end with a central opening therethrough and a lower end with a central opening therethrough; and said indicating plunger is disposed in said housing to reciprocate in said cavity, such that said second end extends through said central opening in said lower end of said housing and, when said plunger is in said second position, said first end of said plunger extends through said central opening in said upper end of said housing.

3. Apparatus of claim 1 wherein said spring means is characterized by a helical coil spring.

4. Apparatus of claim 1 wherein said connecting means is characterized by a flexible cable.

5. Apparatus of claim 4 wherein said cable is a metal chain.

6. Apparatus of claim 1 further comprising an electricial switch in operative association with said indicating plunger, whereby said switch completes an electrical connection when said plunger is in said second position.

7. A plug detector apparatus to indicate position of a drain plug in a small boat or craft by activating a lamp, alarm or the like, said detector apparatus comprising:

an electrical switch having a housing with stationary contacts insulated from one another and a movable contact therein, said switch having an open position when said movable contact is spaced apart from said stationary contacts and a closed position when said movable contact is in electrical communication with said stationary contact;

spring means disposed in said switch to bias said movable contact from said open position to said closed position; and connecting means of predetermined length connecting said movable contact to said plug, whereby, when said plug is installed, said switch is in said open position, and when said plug is not installed, said spring means moves said movable contact to place the switch in said closed position.

8. Apparatus of claim 7 wherein:

said housing is characterized as a substantially hollow cylinder defining a cavity therein, having a lower end with a central opening therethrough and an upper end;

said stationary contacts are attached to an upper inside surface of said housing;

said apparatus further comprises a plunger, disposed in said housing to reciprocate in said cavity, having a first end and a second end opposite said first end, said second end extending through said central opening in said housing; and said movable contact is attached to said first end of said plunger.

9. Apparatus of claim 7 wherein said spring means is characterized by a helical coil spring.

10. Apparatus of claim 7 wherein said connecting means is characterized by a flexible cable.

11. Apparatus of claim 10 wherein said cable is a metal chain.

12. Apparatus of claim 7 further comprising an indicating plunger in operative association with said movable contact, said plunger having a first end and a second end opposite said first end, such that said first end is substantially flush with an outer surface of said housing when said switch is in said open position and said first end extends outwardly away from said housing outer surface when said switch is in said closed position.

13. A plug detector apparatus to indicate position of a drain plug in a small boat or craft, said detection apparatus comprising:

a housing of substantially hollow cylindrical configuration defining a cavity therein and having an upper end with a central opening therethrough and a lower end with a central opening therethrough;

a plunger disposed in said housing to reciprocate therein, said plunger comprised of:

a cylindrical rod having a first end and a second end opposite said first end, said second end extending through said central opening in said lower end of said housing; and a radially extending circular flange on said rod between said first and second ends, said plunger having a first position in which said first end of said rod is substantially flush with an outer surface of said upper end of said housing adjacent said central opening therein and a second position in which first end extends through said opening and outwardly away from said upper end of said housing;

an electrical switch comprised of:

a pair of stationary electrical contacts attached to an upper inside surface of said housing cavity, said contacts being electrically insulated from one another; and a movable electrical contact attached to an upper surface of said flange of said plunger, said switch having an open position in which said movable contact is spaced apart from said stationary contacts when said plunger is in said first position and a closed position in which said movable contact is in electrical communication with said stationary contacts when said plunger is in said second position;

spring means disposed in said cavity actively bearing on a lower surface of said flange and a lower inside surface defining said cavity in said housing, to concurrently bias said plunger from said first position to said second position and said movable contact from said open position to said closed position; and connecting means of predetermined length connecting said second end of said rod to said plug, whereby, when said plug is installed, said plunger is in said first position and said movable contact is in said open position, and when said plug is not installed, said spring means moves said plunger to said second position and said movable contact to said closed position.

14. Apparatus of claim 13 wherein said spring means is characterized by a helical coil spring.

15. Apparatus of claim 13 wherein said connecting means is characterized by a flexible cable.

16. Apparatus of claim 15 wherein said cable is a metal chain.

* * * * *